US011903510B2

(12) United States Patent
Chen et al.

(10) Patent No.: US 11,903,510 B2
(45) Date of Patent: Feb. 20, 2024

(54) EXTENDABLE RAIL

(71) Applicant: GUANGDONG RAEX INTELLIGENT TECHNOLOGY CO., LTD., Guangzhou (CN)

(72) Inventors: Weiping Chen, Guangzhou (CN); Jinbin Tan, Guangzhou (CN)

(73) Assignee: GUANGDONG RAEX INTELLIGENT TECHNOLOGY CO., LTD., Guangzhou (CN)

( * ) Notice: Subject to any disclaimer, the term of this patent is extended or adjusted under 35 U.S.C. 154(b) by 504 days.

(21) Appl. No.: 17/287,892

(22) PCT Filed: Dec. 31, 2019

(86) PCT No.: PCT/CN2019/130322
§ 371 (c)(1),
(2) Date: Apr. 22, 2021

(87) PCT Pub. No.: WO2021/008094
PCT Pub. Date: Jan. 21, 2021

(65) Prior Publication Data

US 2021/0393067 A1 Dec. 23, 2021

(30) Foreign Application Priority Data

Jul. 16, 2019 (CN) ..... 201921119266.2

(51) Int. Cl.
*A47H 1/08* (2006.01)
*A47H 3/10* (2006.01)
*A47H 5/032* (2006.01)

(52) U.S. Cl.
CPC ..... *A47H 1/08* (2013.01); *A47H 3/10* (2013.01); *A47H 5/0325* (2013.01)

(58) Field of Classification Search
CPC ..... A47H 1/08; A47H 3/10; A47H 5/0325
See application file for complete search history.

(56) References Cited

U.S. PATENT DOCUMENTS 5,791,394 A * 8/1998 Huang ..... A47H 1/08 16/95 D
8,708,026 B2 * 4/2014 Graves ..... A47H 5/0325 160/330

(Continued)

FOREIGN PATENT DOCUMENTS

CN 2516065 Y 10/2002
CN 105852607 A 8/2016

(Continued)

OTHER PUBLICATIONS

International Search Report dated Apr. 2, 2020 for International Patent Application No. PCT/CN2019/130322.

*Primary Examiner* — Beth A Stephan

(57) ABSTRACT

Provided is an extendable rail, comprising a main rail and an auxiliary rail arranged in parallel with the main rail, the main rail is shifted in longitudinal direction relative to the auxiliary rail, wherein the main rail is configured with a driving wheel and a first reverse wheel; the auxiliary rail is configured with a second reverse wheel, a first guiding wheel and a second guiding wheel arranged inside; a belt loop with fixed length wraps around the driving wheel, the first reverse wheel, the first guiding wheel, the second reverse wheel, the second guiding wheel, and the driving wheel in turn. The total length of the extendable rail can be adjusted according to the practical needs of consumers by adjusting the length of the overlapped area of the main rail and the auxiliary rail, which provides easy adjustment, high universal applicability and operation performance without size customization.

6 Claims, 2 Drawing Sheets

(56) References Cited

U.S. PATENT DOCUMENTS

| | | | | |
|---|---|---|---|---|
| 2021/0369034 | A1* | 12/2021 | Tan | E05F 3/16 |
| 2022/0378237 | A1* | 12/2022 | Xie | A47H 1/08 |

FOREIGN PATENT DOCUMENTS

| | | | |
|---|---|---|---|
| CN | 107080443 | A | 8/2017 |
| CN | 208551018 | U | 3/2019 |
| CN | 110169703 | A | 8/2019 |
| JP | 5728637 | B1 | 6/2015 |

* cited by examiner

EXTENDABLE RAIL

CROSS REFERENCE TO RELATED APPLICATION

This application claims priority to PCT Application PCT/CN2019/130322 filed on Dec. 31, 2019, which is based on Chinese Application No. 201921119266.2 filed on Jul. 16, 2019, under U.S.C. § 119, the entire contents of which are hereby incorporated by reference.

TECHNICAL FIELD

The following relates to the field of a curtain, in particular to the field of an extendable rail for curtain.

BACKGROUND OF INVENTION

Curtain is houseware installed at the window for light-shading. Generally, windows are provided in different sizes. Therefore, the width of the windows needed to be measured before curtains being produced and installed, such that curtain rails could be produced in accordance with the measurements. Such method has disadvantages as follows, firstly, on-site measurement is required, Which costs lots of labor, and any mistakes occur during measurements or productions will result in rework, which is a waste of time and materials; secondly, customization is low in efficiency and high in cost; customized curtain rails couldn't be used for windows with other sizes once the length of the curtain rail is determined, any changes occur in the size of the windows due to decoration or other reasons would make the electric curtain rail already made as the original size to be wasted.

SUMMARY OF THE INVENTION

It is an object of an aspect of the invention to provide an extendable rail of which the length is adjustable.

According to an aspect related to the invention, provided is an extendable rail, comprising a main rail and an auxiliary rail arranged in parallel with the main rail, the main rail and the auxiliary rail are overlappingly positioned, wherein the main rail is configured with a driving wheel at one end and a first reverse wheel at the other end; the auxiliary rail is configured with a second reverse wheel at the end that is away from the driving wheel and a transition arrangement at the end approximate to the driving wheel, wherein the transition arrangement comprises a transition casing with a first guiding wheel and a second guiding wheel arranged inside; a belt loop with fixed length wraps around the driving wheel, the first reverse wheel, the first guiding wheel, the second reverse wheel, the second guiding wheel, and the driving wheel in turn.

In a further aspect of the invention, the driving wheel is a timing pulley.

In a further aspect of the invention, each of the first reverse wheel, the second reverse wheel, the first guiding wheel, and the second wheel is configured as a pulley.

In a further aspect of the invention, the belt loop is a closed loop timing belt with fixed length formed by an open-ended timing belt and a connector.

In a further aspect of the invention, a first regulating wheel is provided at the other side of the belt loop opposite to the first guiding wheel, the distance from the bottom of the first regulating wheel to the auxiliary rail is greater than the thickness of the belt.

In a further aspect of the invention, a second regulating wheel(s) is provided at the other side of the belt loop opposite to the second guiding wheel.

The present invention has following technical advantages: the extendable rail can be adjusted according to the practical needs of consumers themselves by adjusting the length of the overlapped area between the main rail and the auxiliary rail, which provides easy adjustment, high universal applicability and operation performance without size customization.

BRIEF DESCRIPTION OF DRAWINGS

The present invention will be described hereinafter in details with reference to the figures and the embodiments, obviously, the figures to be described below are merely embodiments of the present invention. For those skilled in the art, other figures may be obtained according to these figures without any creative work.

DETAILED DESCRIPTION OF THE INVENTION

Figure 1:
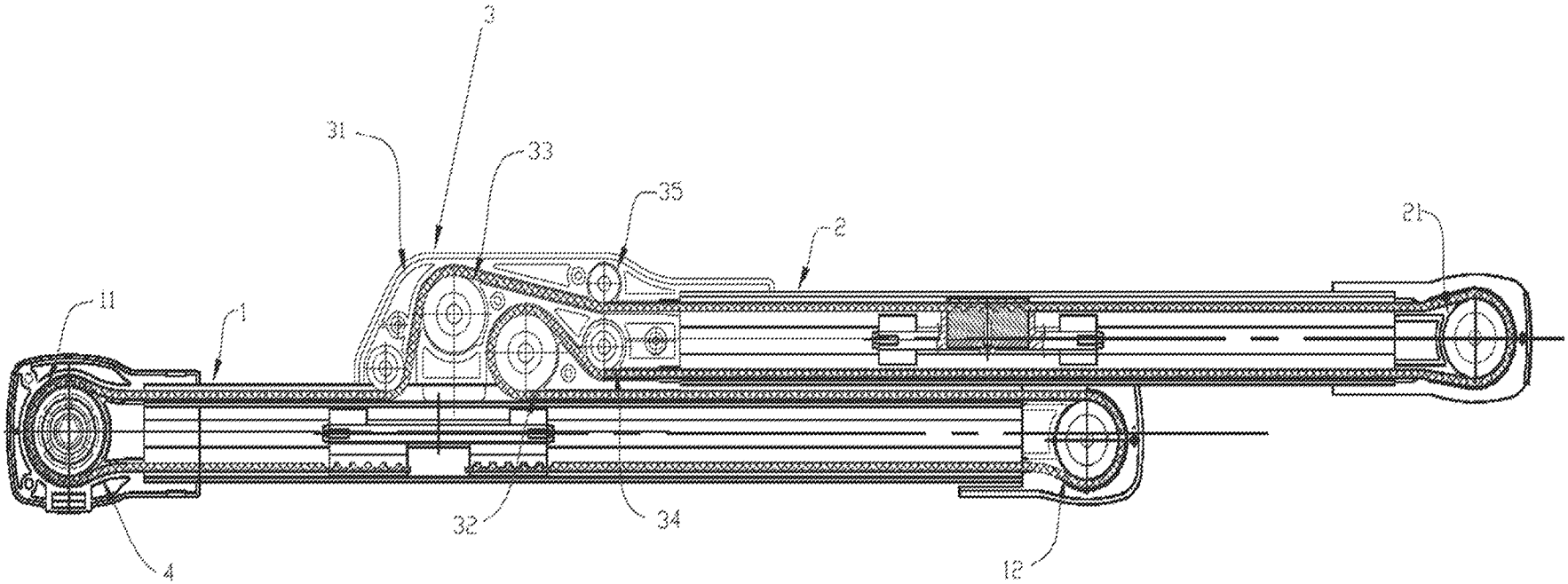
FIG. 1 is a cross sectional view of an embodiment according to the present invention.
Figure 2:
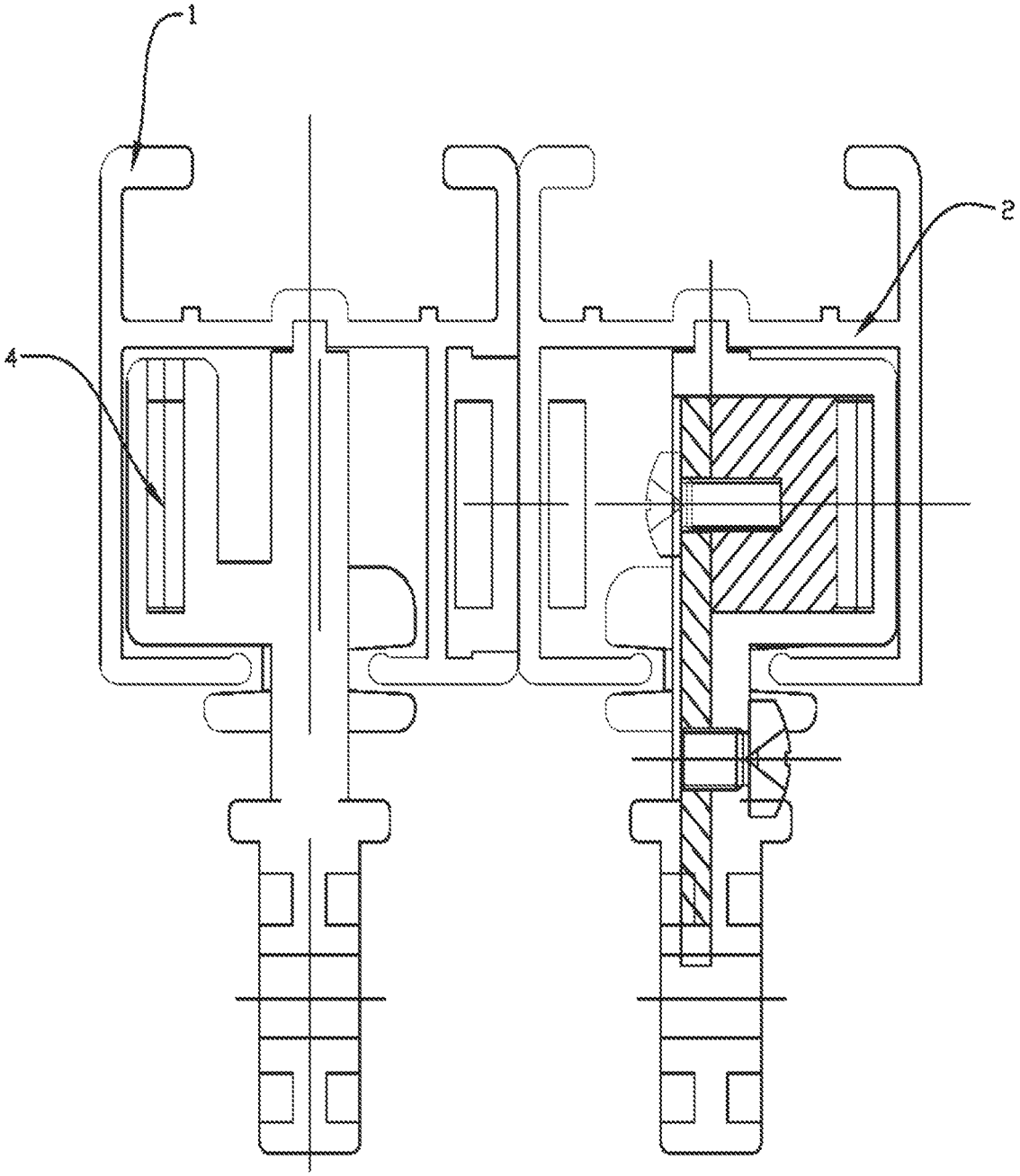
FIG. 2 is a side cutaway view of the embodiment in FIG. 1 according to the present invention.

Referring to FIGS. 1 and 2, provided is an extendable rail, comprising a main rail 1 and an auxiliary rail 2 arranged in parallel with the main rail 1, the main rail 1 is shifted in longitudinal direction relative to the auxiliary rail 2 such that they are overlappingly positioned, The main rail 1 is configured with a driving wheel 11 at the end away from the auxiliary rail 2 and a first reverse wheel 12 at the other end; the auxiliary rail 2 is configured with a second reverse wheel 21 at the end that is away from the driving wheel 11 and a transition arrangement 3 at the other end approximate to the driving wheel 11. The transition arrangement 3 comprises a transition casing 31 with a first guiding wheel 32 and a second guiding wheel 33 arranged inside, wherein a belt loop 4 with fixed length wraps around the driving wheel 11, the first reverse wheel 12, the first guiding wheel 32, the second reverse wheel 21, the second guiding wheel 33 and the driving wheel 11 in turn, thereby the belt leaves the top point of the first reverse wheel 12 and comes into contact with the bottom point of the first guiding wheel 32, and the belt leaves the top point of the second reverse wheel 21 and comes into contact with the top point of the second guiding wheel 33; the top of the second guiding wheel 33 is higher than the top of the first guiding wheel 32. The driving wheel 11 may be configured with a power unit for rotating the driving wheel 11 and thereby driving the belt loop 4 to run.

Preferably, the driving wheel 11 is a timing pulley. Specifically, each of the first reverse wheel 12, the second reverse wheel 21, the first guiding wheel 32, and the second wheel 33 is configured as a pulley. In a preferred embodiment, the belt loop 4 is a closed loop timing belt with fixed length formed by an open-ended timing belt and a connector. Each of the main rail 1 and the auxiliary rail 2 is configured with a traction block in respective sliding groove, each of the traction block is configured with a hanging ring at bottom for hanging curtain. Further, the traction blocks are secured to the belt loop 4 respectively, wherein the traction block in the main rail 1 and the traction block in the auxiliary rail 2 could slide in opposite directions. When the main rail 1 and the auxiliary rail 2 are in a fixed state, the two traction blocks could be driven to slide in opposite directions by the belt loop 4, thereby opening or closing the curtain.

In the embodiment shown in FIG. 1, the belt leaves the top point of the first reverse wheel 12 and comes into contact with the bottom point of the first guiding wheel 32, and the belt loop 4 wraps around the first guiding wheel 32 and the first reverse wheel 12, wherein the top of the first guiding wheel 32 is higher than the bottom of the auxiliary rail 2, and a difference in height exists between the first guiding wheel 32 and the second reverse wheel 21. Preferably, a first regulating wheel 34 is provided at the other side of the belt loop 4 opposite to the first guiding wheel 32 in the auxiliary rail 2, the distance from the bottom of the first regulating wheel 34 to the auxiliary rail 2 is greater than the thickness of the belt loop 4. The belt leaves the bottom point of the first regulating wheel 34 and comes into contact with the bottom point of the second reverse wheel 21, so that the belt loop 4 is repositioned by the first regulating wheel 34 to run inside the auxiliary rail 2, and interference of the belt loop 4 could be avoid.

The top of the second guiding wheel 33 is higher than the top of the first guiding wheel 32, as shown in FIG. 1, so that the interference of the belt loop 4 may be avoided. A second regulating wheel(s) 35 is provided at the other side of the belt loop 4 opposite to the second guiding wheel 33. The top of the second guiding wheel 33 is higher than the top of the second reverse wheel 21, a second regulating wheel 35 is provided at the other side of the belt loop 4 opposite to the second guiding wheel 33 for repositioning the belt loop 4 to avoid the contact between the belt loop 4 and the transition casing 31. Further, there is a corner in the way of the belt loop 4 from the second guiding wheel 33 to the main rail 1, i.e. a joint of the transition casing 31 and the main rail 1, a second regulating wheel 35 may be provided at the corner, wherein the belt leaves the bottom point of the second regulating wheel 35 and comes into contact with the top of the main rail 1, on the one hand, the belt loop 4 is repositioned by the second regulating wheel 35 to run inside the main rail 1, on the other hand, direct contacts between the belt loop 4 and the transition casing 31 or the main rail 1 are avoided.

The extendable rail can be adjusted according to the practical needs of consumers, by adjusting the length of the belt loop wrapping around the overlapped area of the main rail 1 and the auxiliary rail 2, the length of the overlapped area could be adjusted, thus the total length of the main rail 1 and the auxiliary rail 2 could be adjusted as needed, which provides easy adjustment, high universal applicability and operation performance without size customization.

The embodiment described hereinbefore is merely preferred embodiment of the present invention and not for purposes of any restrictions or limitations on the invention. It will be apparent that any non-substantive, obvious alterations or improvement by the technician of this technical field according to the present invention may be incorporated into ambit of claims of the present invention.

What is claimed is:

1. An extendable rail, comprising a main rail (1), an auxiliary rail (2) arranged in parallel with the main rail (1); the main rail (1) is shifted in longitudinal direction relative to the auxiliary rail (2) such that the rails are overlappingly positioned, and the main rail (1) has a main first end and a main second end opposite the main first end, the main rail comprising a driving wheel (11) at the main first end and a first reverse wheel (12) at the main second end; the auxiliary rail (2) has an auxiliary first end and an opposite auxiliary second end, the auxiliary first end is outwardly spaced from the main second end and comprises a second reverse wheel (21), and a transition arrangement at the auxiliary second end between the first and second main ends; the transition arrangement (3) comprises a transition casing (31) with a first guiding wheel (32) and a second guiding wheel (33) arranged inside;

a belt loop (4) with a fixed length is wrapped around a portion of the driving wheel (11), the first reverse wheel (12), the first guiding wheel (32), the second reverse wheel (21), the second guiding wheel (33), and another portion of the driving wheel (11) to form the loop.

2. The extendable rail of claim 1, wherein the driving wheel (11) is a timing pulley.

3. The extendable rail of claim 2, wherein the first reverse wheel (12), the second reverse wheel (21), the first guiding wheel (32), and the second wheel (33) are all configured as a pulley.

4. The extendable rail of claim 3, wherein the belt loop (4) is a closed loop timing belt with the fixed length formed by an open-ended timing belt and a connector.

5. The extendable rail of claim 1, wherein a first regulating wheel (34) is provided at a side of the belt loop (4) opposite to the first guiding wheel (32) in the auxiliary rail (2), and a distance from a bottom of the first regulating wheel (34) to the auxiliary rail (2) is greater than a thickness of the belt loop (4).

6. The extendable rail of claim 2, wherein a second regulating wheel (35) is provided at a side of the belt loop (4) opposite to the second guiding wheel (33).

* * * * *